US006286408B1

(12) United States Patent
Sanford et al.

(10) Patent No.: US 6,286,408 B1
(45) Date of Patent: Sep. 11, 2001

(54) ENERGY-ABSORBING COUNTERMASS ASSEMBLY FOR RECOILLESS WEAPONS

(75) Inventors: Matthew Sanford, Bel Alton, MD (US); Thomas A. DelGuidice, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/477,147

(22) Filed: Jan. 4, 2000

(51) Int. Cl.[7] ..... F41A 1/08; F41A 19/00
(52) U.S. Cl. ..... 89/1.701; 89/1.7
(58) Field of Search ..... 89/1.7, 1.701

(56) References Cited

U.S. PATENT DOCUMENTS

| | | | | |
|---|---|---|---|---|
| 1,395,630 | | 11/1921 | Davis . | |
| 3,149,531 | | 9/1964 | Musgrave | 89/1.7 |
| 3,216,323 | | 11/1965 | Wengenroth et al. | 89/1.7 |
| 3,279,319 | | 10/1966 | Semonian et al. | 89/1.81 |
| 3,307,451 | | 3/1967 | Bucklisch et al. | 89/1.701 |
| 3,677,131 | | 7/1972 | Nee | 89/1.703 |
| 3,779,130 | | 12/1973 | Schnabele | 89/1.701 |
| 3,800,656 | | 4/1974 | Schnäbele | 89/1.701 |
| 4,132,148 | | 1/1979 | Meistring et al. | 89/1.701 |
| 4,527,457 | | 7/1985 | Fikse | 89/8 |
| 4,574,680 | | 3/1986 | Nicodemus | 89/1.701 |
| 4,643,071 | | 2/1987 | Baechler et al. | 89/1.701 |
| 4,759,430 | * | 7/1988 | Kalin | 89/1.701 |
| 5,285,713 | | 2/1994 | Brage | 89/1.704 |
| 5,491,917 | * | 2/1996 | Dilhan et al. | 89/1.701 |

* cited by examiner

*Primary Examiner*—Charles T. Jordan
*Assistant Examiner*—Nicholas W DiCostanzo
(74) *Attorney, Agent, or Firm*—James B. Bechtel, Esq.; Peter J. Van Bergen, Esq.

(57) ABSTRACT

An energy-absorbing countermass assembly for a weapon has a crushable section, a piston at the forward end of the crushable section, and at the rearward end of the crushable section. The countermass can be a rupturable enclosure filled with a dispersible material.

20 Claims, 2 Drawing Sheets

ENERGY-ABSORBING COUNTERMASS ASSEMBLY FOR RECOILLESS WEAPONS

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to weapon recoil attenuation, and more particularly to an energy-absorbing countermass assembly suitable for use in rocket and powder-charge propelled weapon systems.

BACKGROUND OF THE INVENTION

Recoil force attenuation is an ongoing concern in weapon design. For example, a shoulder-launched weapon in an open-ended launch tube traditionally uses either rocket propulsion or a powder charge with a countermass. Rocket propulsion operates by firing within the launcher tube, with the rocket exhaust exiting the open rear of the tube. The primary disadvantage of rocket propulsion is that a lethal zone is created behind the launcher by the combination of shock waves, rapidly moving hot gas, and high sound levels. Large smoke and flash discharge can be used to identify the position of the gunner. Accordingly, the above characteristics prevent the use of rocket systems within a confined space such as an enclosed fortification or bunker.

A variant of the rocket propulsion method is to fire the round out of the tube with a small charge, and then ignite the rocket when it is a safe distance from the gunner. The disadvantage of this method is that additional components (with potential failure mechanisms) are required. Additionally, guidance mechanisms must be incorporated into the round thereby increasing the cost and complexity of the system.

The powder-charge propulsion method operates by firing a powder charge within the launcher tube with the charge sandwiched between the round and a countermass. The round is fired out the front of the launcher tube while a countermass is discharged out the rear of the launcher tube. The disadvantage of the powder-charge method is that the countermass becomes a lethal projectile traveling rearward at high velocity thereby endangering anything in its path.

A variant of the power-charge propulsion method is the use of a frangible countermass which upon exiting the launch tube breaks up into small, lightweight pieces. These pieces slow down rapidly due to the high drag per unit mass. The discharge from the rear of the launcher tube remains dangerous at close range and the smoke and flash can be used to identify the position of the gunner.

SUMMARY OF THE INVENTION

Accordingly, it is an object of the prevent invention to provide a countermass assembly that attenuates recoil forces in a weapon.

Another object of the present invention is to provide a countermass assembly for use in a rocket or powder-charge propelled weapon system.

Other objects and advantages of the present invention will become more obvious hereinafter in the specification and drawings.

In accordance with the present invention, an energy-absorbing countermass assembly for a weapon. A crushable section has a forward end and a rearward end. A piston is positioned at the forward end of the crushable section. A countermass is positioned at the rearward end of the crushable section.

When the weapon is fired, high pressure gas expands between the weapon's round and the assembly's piston. All work being performed on the round is used to increase the velocity thereof. However, work being performed on the piston is partially expended in accelerating the piston and partially absorbed by the crushable section as it is compressed between the piston and the countermass. During the crush phase, the force transmitted to the countermass is limited to the crush strength of the crushable section. Thus, while the round leaves the weapon at its design velocity, the crushable section compresses during launch so that the countermass leaves the rear of the weapon at a much reduced velocity.

DETAILED DESCRIPTION OF THE INVENTION

Figure 1:
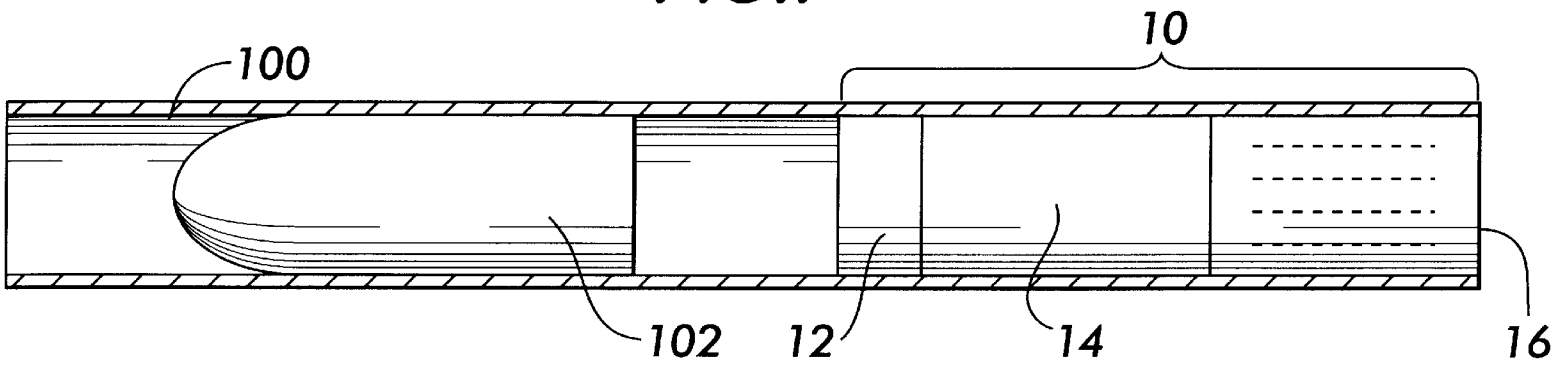
FIG. 1 is a cross-sectional side view of a weapon's launch tube showing a round and the energy-absorbing countermass assembly in firing position in accordance with the present invention.

Referring now to FIG. 1, the energy-absorbing countermass assembly of the present invention is referenced generally by numeral 10. Assembly 10 is shown inserted in a barrel or launch tube 100 of a weapon immediately behind a round 102. Round 102 can be propelled from launch tube 100 by means of either a powder charge or rocket propulsion.

Energy-absorbing countermass assembly 10 comprises three major components, a piston 12 located on the forward end Of energy-absorbing countermass assembly 10, a crushable center section 14, and a countermass 16 which can be solid or constructed as a rupturable assembly as will be explained below.

Figure 2:
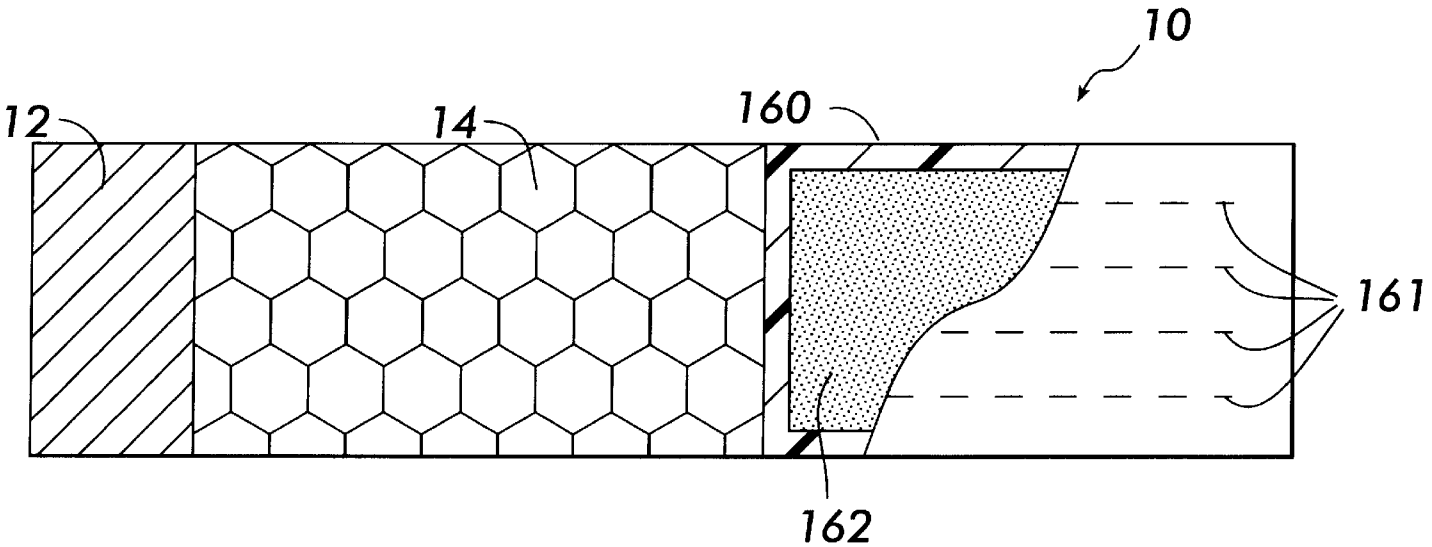
FIG. 2 is a partial side, partial sectional view of an embodiment of the energy-absorbing countermass assembly that produces a non-lethal weapon exhaust.

FIG. 2 shows a preferred embodiment construction of energy-absorbing countermass assembly 10. Piston 12 is coupled or attached to compressible center section 14 which, in turn, is coupled or attached to countermass 16. Piston 12 is made from a lightweight material such as aluminum, titanium or carbon-fiber composites, just to name a few. Compressible center section 14 is a crushable section which, in the preferred embodiment, is a honeycomb structure. Honeycomb crush structures made from aluminum are known in the art and are available commercially from, for example, Plascore Incorporated, Zeeland, Michigan.

As mentioned above, countermass 16 can be a solid countermass. However, if the exit zone of the weapon must be made safe, countermass 16 can be constructed as shown in FIG. 2. Specifically, countermass 16 is a rupturable container or enclosure 160 filled with a material 162 that is heavy enough to serve as a countermass and that will disperse once enclosure 160 ruptures as will be explained below. Enclosure 160 can be made from a material that will retain its integrity during normal handling but rupture in use as will be explained below. To facilitate such rupture, the walls of enclosure 160 can be scored longitudinally at 161 thereby ensuring that enclosure 160 has little radial strength. Suitable materials for enclosure 160 include polypropylene, paper or cardboard, and metal foil such as aluminum foil.

Dispersible material 162 is a non-lethal material that will readily disperse when released from enclosure 160. For example, material 162 can be a fluid (e.g., water), a solid material or combinations of different solid materials in particle form (e.g., sand; flaked or powdered metal, glass, cellulose, etc.; or composites), or combinations of fluids, fibers and flakes.

Figure 3:
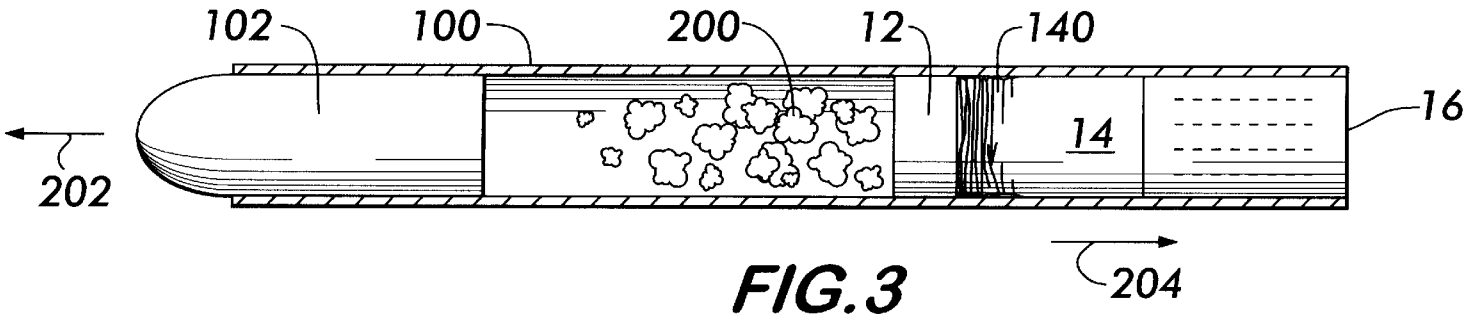
FIG. 3 is a cross-sectional side view of the launch tube showing a round and the energy-absorbing countermass assembly immediately after firing.

Operation of the present invention will now be explained with reference to FIGS. 3, 4 and 5. It will be assumed that energy-absorbing countermass assembly 10 is constructed as illustrated in FIG. 2. Referring now to FIG. 3, immediately after firing of a rocket or powder charge (neither of which is shown) between round 102 and piston 12, propulsion gases 200 act on round 102 and piston 12. Round 102 begins to move forward in launch tube 100 in the direction of arrow 202. Piston 12 begins to move rearward in launch tube 100 in the direction of arrow 204. Movement of piston 12 begins the compression of crushable center section 14. The crush resistance of crushable center section 14 is gradually increased from front to rear, thereby allowing a progressive crushing from the front of the energy-absorbing countermass assembly to form a crushed section illustrated by rippled lines 140. The mass of countermass 16 is sufficiently large so that very little rearward movement occurs immediately after firing.

Figure 4:
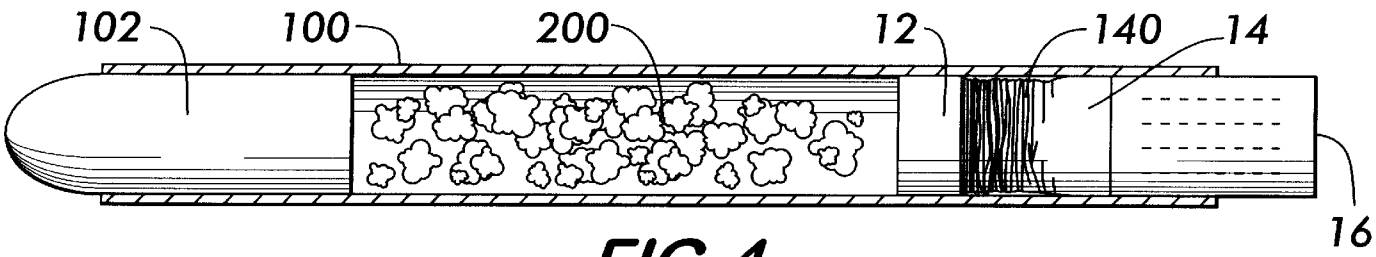
FIG. 4 is a cross-sectional side view of the launch tube showing the round and the energy-absorbing countermass assembly just prior to muzzle exit by the round.

FIG. 4 shows the weapon with round 102 just prior to muzzle exit from launch tube 100. At this point, energy-absorbing countermass assembly 10 has partially exited the exhaust end of launch tube 100 since piston 12 has compressed crushable center section 14 so that crushed section 140 has grown and absorbed a part of the firing energy. The remaining firing energy is transferred to countermass 16.

Figure 5:
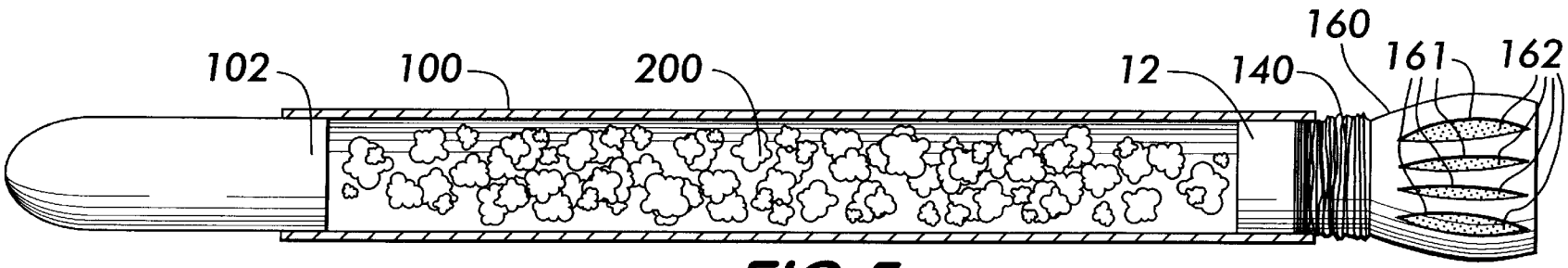
FIG. 5 is a cross-sectional side view of the launch tube showing the round and the energy-absorbing countermass assembly immediately after muzzle exit by the round.

Referring now to FIG. 5, immediately after round 102 exits launch tube 100, energy-absorbing countermass assembly 10 also exits the exhaust end of launch tube 100. Piston 12 has now fully compressed crushable center section 14 leaving a fully crushed section 140 extending between piston 12 and countermass 16. When the compression ends, the last movement of the compressible material causes the rupture of enclosure 160 and a release of dispersible material 162 into the surrounding environment. Rupture occurs because enclosure 160 is under compression while no longer being radially constrained by launch tube 100. As longitudinal scores 161 fail, dispersible material 162 is expelled from enclosure 160.

The theory of the present invention can be explained as follows. Energy absorbing countermass assembly 10 uses a compressible energy-absorbing material with a moveable countermass. When the weapon is fired, a high pressure gas expands between two pistons, i.e., round 102 and piston 12 which is attached to the forward end of crushable center section 14. As round 102 and piston 12 move apart, work is done (work=force×distance) on each assembly. For round 102, this work takes the form of an increase in velocity (kinetic energy=½ $mv^2$). For energy-absorbing countermass assembly 10, part of the work is expended in accelerating piston 12. Another part of the work is absorbed by crushable center section 14 as it is compressed between piston 12 and countermass 16. During the crush phase, the force transmitted to countermass 16 is limited to the crush strength of crushable center section 14. For these reasons, countermass 16 experiences a much lower accelerating force than round 102, and therefor leaves launch tube 100 with much less velocity.

The advantages of the present invention are numerous. While the round leaves the launch tube at its design velocity, the crushable center section compresses during launch so that the countermass leaves the rear of the launch tube at a much reduced velocity. Initial analysis indicates that the configuration of the present invention can reduce the exit velocity of the countermass relative to the exit velocity of the round if the burn time of the propelling charge is of short duration. As such, the countermass of the present invention will greatly reduce the threat at the rear of the launch tube. Additionally, flash and smoke exiting the exhaust of the launch tube are greatly reduced because the propellant has more time to burn completely while both ends of the launch tube are blocked. Thus, the weapon can be fired covertly and safely in partially enclosed fortifications such as bunkers.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An energy-absorbing countermass assembly for a weapon, comprising:

a crushable section having a forward end and a rearward end;

a piston positioned at said forward end of said crushable section; and a countermass positioned at said rearward end of said crushable section, wherein said countermass comprises a rupturable enclosure containing a dispersible material.

2. An energy-absorbing countermass assembly as in claim 1, wherein said crushable section comprises a honeycomb structure.

3. An energy-absorbing countermass assembly as in claim 1, wherein said honeycomb structure is constructed of aluminum.

4. An energy-absorbing countermass assembly as in claim 1, wherein said piston is selected from the group consisting of aluminum, titanium and carbon fiber composites.

5. An energy-absorbing countermass assembly as in claim 1, wherein said rupturable enclosure is made from a material selected from the group consisting of polypropylene, paper, cardboard and metal foil.

6. An energy-absorbing countermass assembly as in claim 1, wherein said dispersible material comprises a fluid.

7. An energy-absorbing countermass assembly as in claim 1, wherein said dispersible material comprises water.

8. An energy-absorbing countermass assembly as in claim 1, wherein said dispersible material comprises particles of solid material.

9. An energy-absorbing countermass assembly for a weapon, comprising:

an aluminum honeycomb section having a forward end and a rearward end;

a piston positioned at said forward end of said aluminum honeycomb section; and a rupturable enclosure containing a dispersible material, said rupturable enclosure positioned at said rearward end of said aluminum honeycomb section.

10. An energy-absorbing countermass assembly as in claim 9, wherein said piston is selected from the group consisting of aluminum, titanium and carbon fiber composites.

11. An energy-absorbing countermass assembly as in claim 9, wherein said rupturable enclosure is made from a material selected from the group consisting of polypropylene, paper, cardboard and metal foil.

12. An energy-absorbing countermass assembly as in claim 9, wherein said dispersible material comprises a fluid.

13. An energy-absorbing countermass assembly as in claim 9, wherein said dispersible material comprises water.

14. An energy-absorbing countermass assembly as in claim 9, wherein said dispersible material comprises particles of solid material.

15. An energy-absorbing countermass assembly for a weapon, comprising:

an aluminum honeycomb section having a forward end and a rearward end;

a piston attached to said forward end of said aluminum honeycomb section; and a rupturable enclosure containing a dispersible material, said rupturable enclosure attached to said rearward end of said aluminum honeycomb section.

16. An energy-absorbing countermass assembly as in claim 15, wherein said piston is selected from the group consisting of aluminum, titanium and carbon fiber composites.

17. An energy-absorbing countermass assembly as in claim 15, wherein said rupturable enclosure is made from a material selected from the group consisting of polypropylene, paper, cardboard and metal foil.

18. An energy-absorbing countermass assembly as in claim 15, wherein said dispersible material comprises a fluid.

19. An energy-absorbing countermass assembly as in claim 15, wherein said dispersible material comprises water.

20. An energy-absorbing countermass assembly as in claim 15, wherein said dispersible material comprises particles of solid material.

* * * * *